US006869165B2

(12) United States Patent
Martin

(10) Patent No.: US 6,869,165 B2
(45) **Date of Patent: *Mar. 22, 2005**

(54) FLUID INTERCONNECT FOR PRINTHEAD ASSEMBLY

(75) Inventor: Michael Martin, Dana Point, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 79 days.

This patent is subject to a terminal disclaimer.

(21) Appl. No.: 10/283,836

(22) Filed: Oct. 30, 2002

(65) Prior Publication Data

US 2004/0085394 A1 May 6, 2004

(51) Int. Cl.[7] ..... B41J 2/155
(52) U.S. Cl. ..... 347/42; 347/65; 347/13
(58) Field of Search ..... 347/64, 65, 66, 347/12, 13

(56) References Cited

U.S. PATENT DOCUMENTS

| | | | |
|---|---|---|---|
| 5,016,023 | A | 5/1991 | Chan et al. |
| 5,057,854 | A | 10/1991 | Pond et al. |
| 5,079,189 | A | 1/1992 | Drake et al. |
| 5,098,503 | A | 3/1992 | Drake |
| 5,160,945 | A | 11/1992 | Drake |
| 5,469,199 | A | 11/1995 | Allen et al. |
| 5,489,930 | A | 2/1996 | Anderson |
| 5,565,900 | A | 10/1996 | Cowger et al. |
| 5,696,544 | A | 12/1997 | Komuro |
| 5,742,305 | A | 4/1998 | Hackleman |
| 5,939,206 | A | 8/1999 | Kneezel et al. |
| 6,123,410 | A | 9/2000 | Beerling et al. |
| 6,250,738 | B1 | 6/2001 | Waller et al. |
| 6,322,206 | B1 | 11/2001 | Boyd et al. |
| 6,341,845 | B1 | 1/2002 | Scheffelin et al. |
| 6,343,857 | B1 | 2/2002 | Cowger |
| 6,431,683 | B1 | 8/2002 | Ho et al. |
| 6,435,653 | B1 | 8/2002 | Boyd et al. |

OTHER PUBLICATIONS

Ross R. Allen, "Inkjet Printing with Large Pagewide Arrays: Issues and Challenges", Recent Progress in Ink Jet Technologies II, pp. 114–120; orginally published in "12th International Congress on Advances in Non–Impact Printing Technologies Proc.", p. 43,1996.

*Primary Examiner*—Lamson Nguyen

(57) ABSTRACT

A printhead assembly includes a carrier having a fluid manifold defined therein such that the fluid manifold includes a first chamber and a second chamber; a plurality of printhead dies each mounted on the carrier and communicating with at least one of the first chamber and the second chamber of the fluid manifold; a fluid delivery assembly coupled with the carrier and including a first chamber and a second chamber; and a fluid interconnect fluidically coupling the first chamber of the fluid manifold with the first chamber of the fluid delivery assembly and the second chamber of the fluid manifold with the second chamber of the fluid delivery assembly.

18 Claims, 9 Drawing Sheets

FLUID INTERCONNECT FOR PRINTHEAD ASSEMBLY

THE FIELD OF THE INVENTION

The present invention relates generally to inkjet printheads, and more particularly to a fluid interconnect for a printhead assembly.

BACKGROUND OF THE INVENTION

A conventional inkjet printing system includes a printhead, an ink supply which supplies liquid ink to the printhead, and an electronic controller which controls the printhead. The printhead ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

In one arrangement, commonly referred to as a wide-array inkjet printing system, a plurality of individual printheads, also referred to as printhead dies, are mounted on a single carrier. As such, a number of nozzles and, therefore, an overall number of ink drops which can be ejected per second is increased. Since the overall number of ink drops which can be ejected per second is increased, printing speed can be increased with the wide-array inkjet printing system.

When mounting a plurality of printhead dies on a single carrier, the single carrier performs several functions including fluid and electrical routing as well as printhead die support. More specifically, the single carrier accommodates communication of ink between the ink supply and each of the printhead dies, accommodates communication of electrical signals between the electronic controller and each of the printhead dies, and provides a stable support for each of the printhead dies. As such, ink from the ink supply is supplied to each of the printhead dies through the carrier.

To communicate ink between the ink supply and the carrier, multiple fluid ports may be provided in the carrier. As such, multiple fluid interconnects are provided between mating parts of the ink supply and the carrier. Unfortunately, processing and/or material variations may result in misalignment or mismatch between the interconnect features of the mating parts.

Accordingly, it is desirable for a fluid interconnect which overcomes misalignment or mismatch between interconnect features of mating parts to communicate ink from the ink supply with the carrier.

SUMMARY OF THE INVENTION

A printhead assembly includes a carrier having a fluid manifold defined therein such that the fluid manifold includes a first chamber and a second chamber; a plurality of printhead dies each mounted on the carrier and communicating with at least one of the first chamber and the second chamber of the fluid manifold; a fluid delivery assembly coupled with the carrier and including a first chamber and a second chamber; and a fluid interconnect fluidically coupling the first chamber of the fluid manifold with the first chamber of the fluid delivery assembly and the second chamber of the fluid manifold with the second chamber of the fluid delivery assembly.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
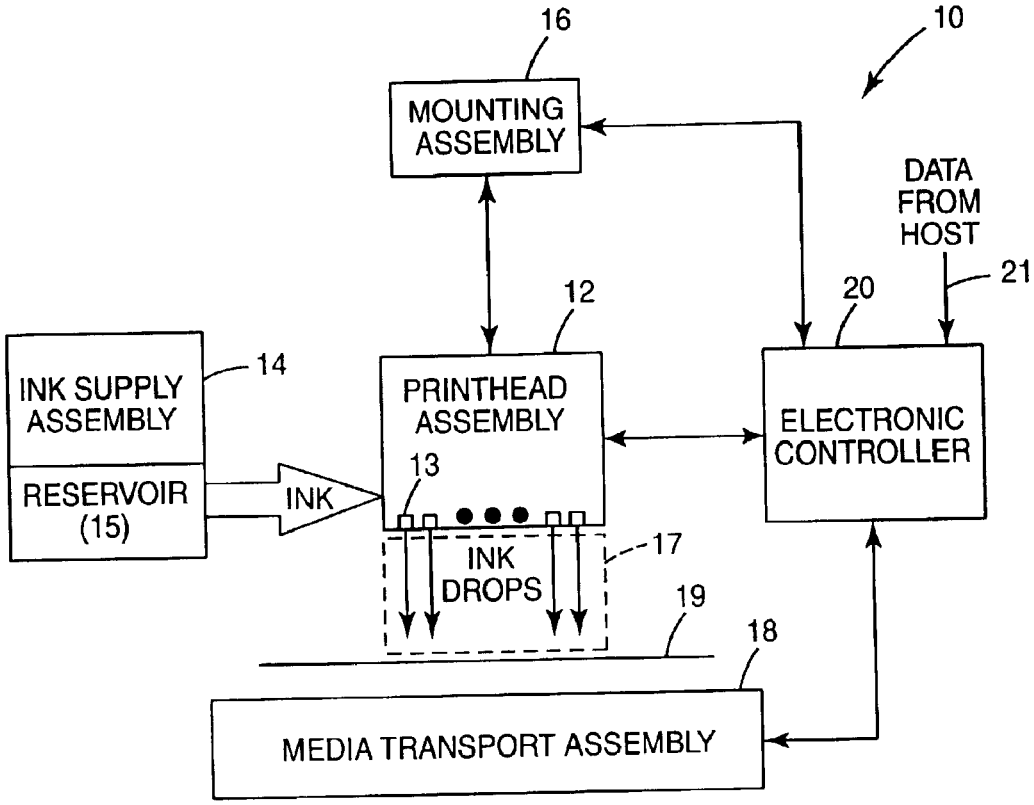
FIG. 1 is a block diagram illustrating one embodiment of an inkjet printing system.

FIG. 1 illustrates one embodiment of an inkjet printing system 10. Inkjet printing system 10 includes an inkjet printhead assembly 12, an ink supply assembly 14, a mounting assembly 16, a media transport assembly 18, and an electronic controller 20. Inkjet printhead assembly 12 is formed according to an embodiment of the present invention, and includes one or more printheads which eject drops of ink or fluid through a plurality of orifices or nozzles 13.

In one embodiment, the drops of ink are directed toward a medium, such as print medium 19, so as to print onto print medium 19. Print medium 19 includes any type of suitable sheet material, such as paper, card stock, transparencies, Mylar, and the like. Typically, nozzles 13 are arranged in one or more columns or arrays such that properly sequenced ejection of ink from nozzles 13 causes, in one embodiment, characters, symbols, and/or other graphics or images to be printed upon print medium 19 as inkjet printhead assembly 12 and print medium 19 are moved relative to each other.

Ink supply assembly 14 supplies ink to inkjet printhead assembly 12 and includes a reservoir 15 for storing ink. As such, in one embodiment, ink flows from reservoir 15 to inkjet printhead assembly 12. In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly and mounting assembly 16 includes a carriage for moving inkjet printhead assembly 12 relative to media transport assembly 18. In another embodiment, inkjet printhead assembly 12 is a non-scanning type printhead assembly and mounting assembly 16 fixes inkjet printhead assembly 12 at a prescribed position relative to media transport assembly 18.

Electronic controller 20 communicates with inkjet printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of inkjet printhead assembly 12 including timing control for ejection of ink drops from nozzles 13. As such, electronic controller 20 defines a pattern of ejected ink drops which form characters, symbols, and/or other graphics or images on print medium 19. Timing control and, therefore, the pattern of ejected ink drops is determined by the print job commands and/or command parameters. In one embodiment, logic and drive circuitry forming a portion of electronic controller 20 is located on inkjet printhead assembly 12. In another embodiment, logic and drive circuitry is located off inkjet printhead assembly 12.

Figure 2:
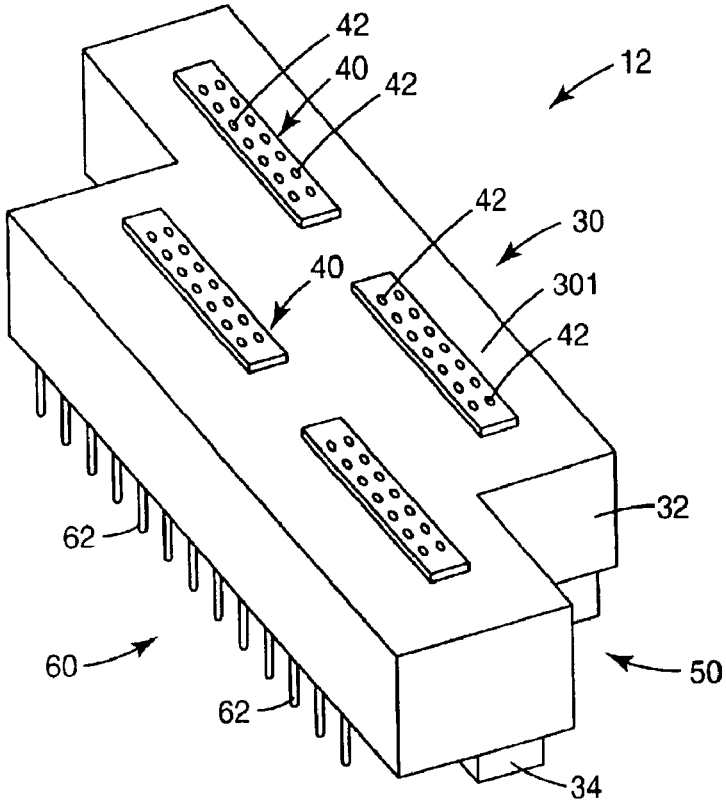
FIG. 2 is a top perspective view illustrating one embodiment of an inkjet printhead assembly.
Figure 3:
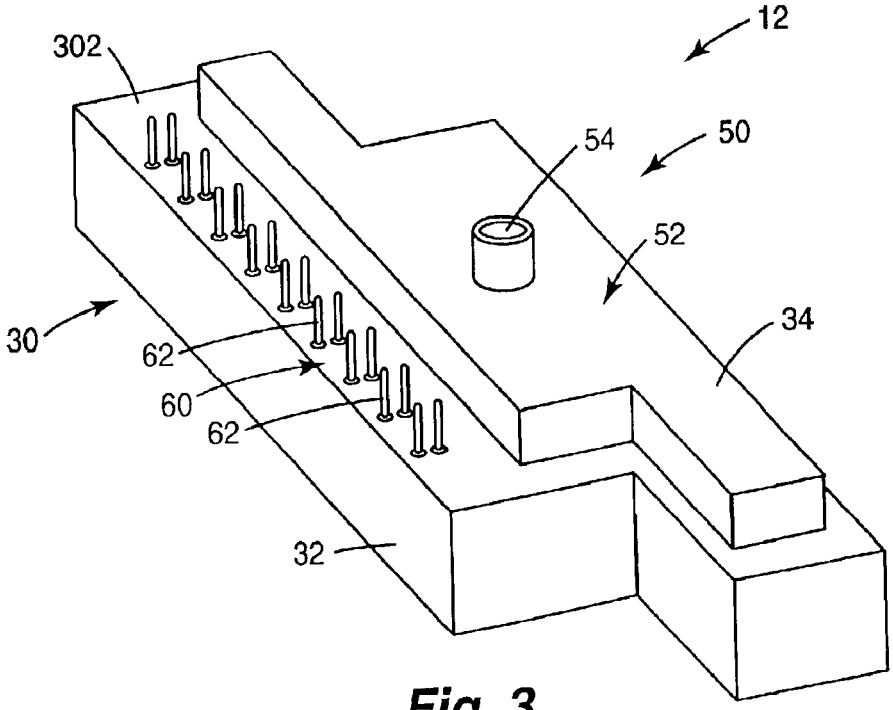
FIG. 3 is a bottom perspective view of the inkjet printhead assembly of FIG. 2.

FIGS. 2 and 3 illustrate one embodiment of a portion of inkjet printhead assembly 12. Inkjet printhead assembly 12 is a wide-array or multi-head printhead assembly and includes a carrier 30, a plurality of printhead dies 40, an ink delivery system 50, and an electronic interface system 60. Carrier 30 has an exposed surface or first face 301 and an exposed surface or second face 302 which is opposite of and oriented substantially parallel with first face 301. Carrier 30 serves to carry or provide mechanical support for printhead dies 40. In addition, carrier 30 accommodates fluidic communication between ink supply assembly 14 and printhead dies 40 via ink delivery system 50 and accommodates electrical communication between electronic controller 20 and printhead dies 40 via electronic interface system 60.

Printhead dies 40 are mounted on first face 301 of carrier 30 and aligned in one or more rows. In one embodiment, printhead dies 40 are spaced apart and staggered such that printhead dies 40 in one row overlap at least one printhead die 40 in another row. Thus, inkjet printhead assembly 12 may span a nominal page width or a width shorter or longer than nominal page width. While four printhead dies 40 are illustrated as being mounted on carrier 30, the number of printhead dies 40 mounted on carrier 30 may vary.

In one embodiment, a plurality of inkjet printhead assemblies 12 are mounted in an end-to-end manner. In one embodiment, to provide for at least one printhead die 40 of one inkjet printhead assembly 12 overlapping at least one printhead die 40 of an adjacent inkjet printhead assembly 12, carrier 30 has a staggered or stair-step profile. While carrier 30 is illustrated as having a stair-step profile, it is within the scope of the present invention for carrier 30 to have other profiles including a substantially rectangular profile.

Ink delivery system 50 fluidically couples ink supply assembly 14 with printhead dies 40. In one embodiment, ink delivery system 50 includes a fluid manifold 52 and a port 54. Fluid manifold 52 is formed in carrier 30 and distributes ink through carrier 30 to each printhead die 40. Port 54 communicates with fluid manifold 52 and provides an inlet for ink supplied by ink supply assembly 14.

Electronic interface system 60 electrically couples electronic controller 20 with printhead dies 40. In one embodiment, electronic interface system 60 includes a plurality of electrical contacts 62 which form input/output (I/O) contacts for electronic interface system 60. As such, electrical contacts 62 provide points for communicating electrical signals between electronic controller 20 and inkjet printhead assembly 12. Examples of electrical contacts 62 include I/O pins which engage corresponding I/O receptacles electrically coupled to electronic controller 20 and I/O contact pads or fingers which mechanically or inductively contact corresponding electrical nodes electrically coupled to electronic controller 20. Although electrical contacts 62 are illustrated as being provided on second face 302 of carrier 30, it is within the scope of the present invention for electrical contacts 62 to be provided on other sides of carrier 30.

Figure 4:
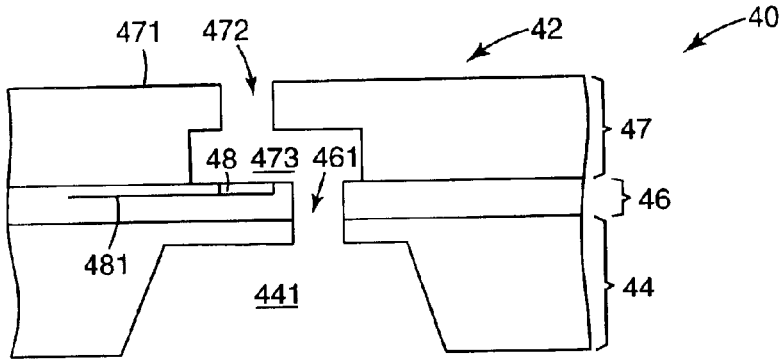
FIG. 4 is a schematic cross-sectional view illustrating portions of one embodiment of a printhead die.

As illustrated in the embodiment of FIGS. 2 and 4, each printhead die 40 includes an array of drop ejecting elements 42. Drop ejecting elements 42 are formed on a substrate 44 which has an ink or fluid feed slot 441 formed therein. As such, fluid feed slot 441 provides a supply of ink or fluid to drop ejecting elements 42. Substrate 44 is formed, for example, of silicon, glass, or a stable polymer.

In one embodiment, each drop ejecting element 42 includes a thin-film structure 46 and an orifice layer 47. Thin-film structure 46 includes a firing resistor 48 and has an ink or fluid feed channel 461 formed therein which communicates with fluid feed slot 441 of substrate 44. Orifice layer 47 has a front face 471 and a nozzle opening 472 formed in front face 471. Orifice layer 47 also has a nozzle chamber 473 formed therein which communicates with nozzle opening 472 and fluid feed channel 461 of thin-film structure 46. Firing resistor 48 is positioned within nozzle chamber 473 and includes leads 481 which electrically couple firing resistor 48 to a drive signal and ground.

Thin-film structure 46 is formed, for example, by one or more passivation or insulation layers of silicon dioxide, silicon carbide, silicon nitride, tantalum, poly-silicon glass, or other suitable material. In one embodiment, thin-film structure 46 also includes a conductive layer which defines firing resistor 48 and leads 481. The conductive layer is formed, for example, by aluminum, gold, tantalum, tantalum-aluminum, or other metal or metal alloy.

In one embodiment, during operation, ink or fluid flows from fluid feed slot 441 to nozzle chamber 473 via fluid feed channel 461. Nozzle opening 472 is operatively associated with firing resistor 48 such that droplets of ink or fluid are ejected from nozzle chamber 473 through nozzle opening 472 (e.g., normal to the plane of firing resistor 48) and toward a medium upon energization of firing resistor 48.

Example embodiments of printhead dies 40 include a thermal printhead, as described above, a piezoelectric printhead, a flex-tensional printhead, or any other type of fluid ejection device known in the art. In one embodiment, printhead dies 40 are fully integrated thermal inkjet printheads.

Figure 5:
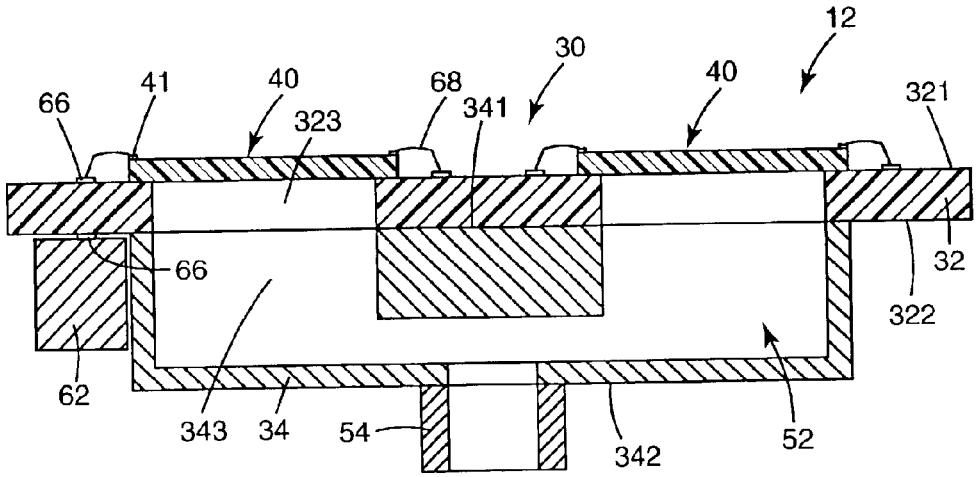
FIG. 5 is a schematic cross-sectional view illustrating one embodiment of an inkjet printhead assembly.

Referring to the embodiment of FIGS. 2, 3, and 5, carrier 30 includes a substrate 32 and a substructure 34. Substrate 32 and substructure 34 provide and/or accommodate mechanical, electrical, and fluidic functions of inkjet printhead assembly 12. More specifically, substrate 32 provides mechanical support for printhead dies 40, accommodates fluidic communication between ink supply assembly 14 and printhead dies 40 via ink delivery system 50, and provides electrical connection between and among printhead dies 40 and electronic controller 20 via electronic interface system 60. Substructure 34 provides mechanical support for substrate 32, accommodates fluidic communication between ink supply assembly 14 and printhead dies 40 via ink delivery system 50, and accommodates electrical connection between printhead dies 40 and electronic controller 20 via electronic interface system 60.

Substrate 32 has a first side 321 and a second side 322 which is opposite first side 321, and substructure 34 has a first side 341 and a second side 342 which is opposite first side 341. In one embodiment, printhead dies 40 are mounted on first side 321 of substrate 32 and substructure 34 is disposed on second side 322 of substrate 32. As such, first side 341 of substructure 34 contacts and is joined to second side 322 of substrate 32.

For transferring ink between ink supply assembly 14 and printhead dies 40, substrate 32 and substructure 34 each have a plurality of ink or fluid passages 323 and 343, respectively, formed therein. Fluid passages 323 extend through substrate 32 and provide a through-channel or through-opening for delivery of ink to printhead dies 40 and, more specifically, fluid feed slot 441 of substrate 44 (FIG. 4). Fluid passages 343 extend through substructure 34 and provide a through-channel or through-opening for delivery of ink to fluid passages 323 of substrate 32. As such, fluid passages 323 and 343 form a portion of ink delivery system 50. Although only one fluid passage 323 is shown for a given printhead die 40, there may be additional fluid passages to the same printhead die, for example, to provide ink of respective differing colors.

In one embodiment, substructure 34 is formed of a non-ceramic material such as plastic. Substructure 34 is formed, for example, of a high performance plastic including a fiber reinforced resin such as polyphenylene sulfide (PPS) or a polystyrene (PS) modified polyphenylene oxide (PPO) or polyphenylene ether (PPE) blend such as NORYL®. It is, however, within the scope of the present invention for substructure 34 to be formed of silicon, stainless steel, or other suitable material or combination of materials. Preferably, substructure 34 is chemically compatible with liquid ink so as to accommodate fluidic routing.

Figure 6:
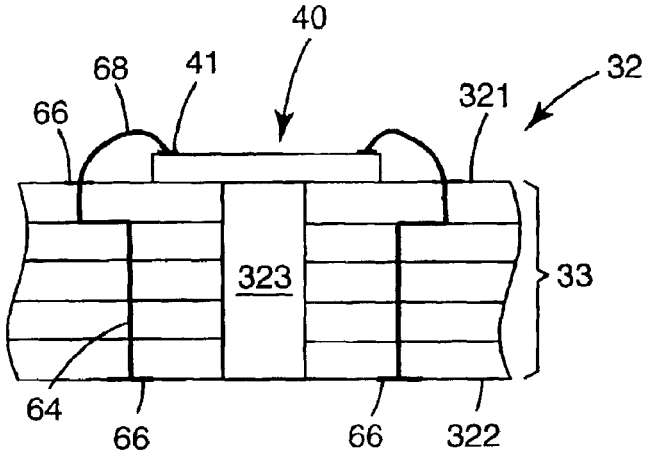
FIG. 6 is a schematic cross-sectional view illustrating one embodiment of a portion of a substrate for an inkjet printhead assembly.

For transferring electrical signals between electronic controller 20 and printhead dies 40, electronic interface system 60 includes a plurality of conductive paths 64 extending through substrate 32, as illustrated in FIG. 6. More specifically, substrate 32 includes conductive paths 64 which pass through and terminate at exposed surfaces of substrate 32. In one embodiment, conductive paths 64 include electrical contact pads 66 at terminal ends thereof which form, for example, I/O bond pads on substrate 32. Conductive paths 64, therefore, terminate at and provide electrical coupling between electrical contact pads 66.

Electrical contact pads 66 provide points for electrical connection to substrate 32 and, more specifically, conductive paths 64. Electrical connection is established, for example, via electrical connectors or contacts 62, such as I/O pins or spring fingers, wire bonds, electrical nodes, and/or other suitable electrical connectors. In one embodiment, printhead dies 40 include electrical contacts 41 which form I/O bond pads. As such, electronic interface system 60 includes electrical connectors, for example, wire bond leads 68, which electrically couple electrical contact pads 66 with electrical contacts 41 of printhead dies 40.

Conductive paths 64 transfer electrical signals between electronic controller 20 and printhead dies 40. More specifically, conductive paths 64 define transfer paths for power, ground, and data among and/or between printhead dies 40 and electrical controller 20. In one embodiment, data includes print data and non-print data.

In one embodiment, as illustrated in FIG. 6, substrate 32 includes a plurality of layers 33 each formed of a ceramic material. As such, substrate 32 includes circuit patterns which pierce layers 33 to form conductive paths 64. In one fabrication methodology, circuit patterns are formed in layers of unfired tape (referred to as green sheet layers) using a screen printing process. The green sheet layers are made of ceramic particles in a polymer binder. Alumina may be used for the particles, although other oxides or various glass/ceramic blends may be used. Each green sheet layer receives conductor lines and other metallization patterns as needed to form conductive paths 64. Such lines and patterns are formed with a refractory metal, such as tungsten, by screen printing on the corresponding green sheet layer. Thereafter, the green sheet layers are fired. Thus, conductive and non-conductive or insulative layers are formed in substrate 32. While substrate 32 is illustrated as including layers 33, it is, however, within the scope of the present invention for substrate 32 to be formed of a solid pressed ceramic material. As such, conductive paths are formed, for example, as thin-film metallized layers on the pressed ceramic material.

While conductive paths 64 are illustrated as terminating at first side 321 and second side 322 of substrate 32, it is, however, within the scope of the present invention for conductive paths 64 to terminate at other sides of substrate 32. In addition, one or more conductive paths 64 may branch from and/or lead to one or more other conductive paths 64. Furthermore, one or more conductive paths 64 may begin and/or end within substrate 32. Conductive paths 64 may be formed as described, for example, in U.S. Pat. No. 6,428,145, entitled "Wide-Array Inkjet Printhead Assembly with Internal Electrical Routing System" assigned to the assignee of the present invention.

It is to be understood that FIGS. 5 and 6 are simplified schematic illustrations of one embodiment of carrier 30, including substrate 32 and substructure 34. The illustrative routing of fluid passages 323 and 343 through substrate 32 and substructure 34, respectively, and conductive paths 64 through substrate 32, for example, has been simplified for clarity of the invention. Although various features of carrier 30, such as fluid passages 323 and 343 and conductive paths 64, are schematically illustrated as being straight, it is understood that design constraints could make the actual geometry more complicated for a commercial embodiment of inkjet printhead assembly 12. Fluid passages 323 and 343, for example, may have more complicated geometries to allow multiple colorants of ink to be channeled through carrier 30. In addition, conductive paths 64 may have more complicated routing geometries through substrate 32 to avoid contact with fluid passages 323 and to allow for electrical connector geometries other than the illustrated I/O pins. It is understood that such alternatives are within the scope of the present invention.

Figure 7:
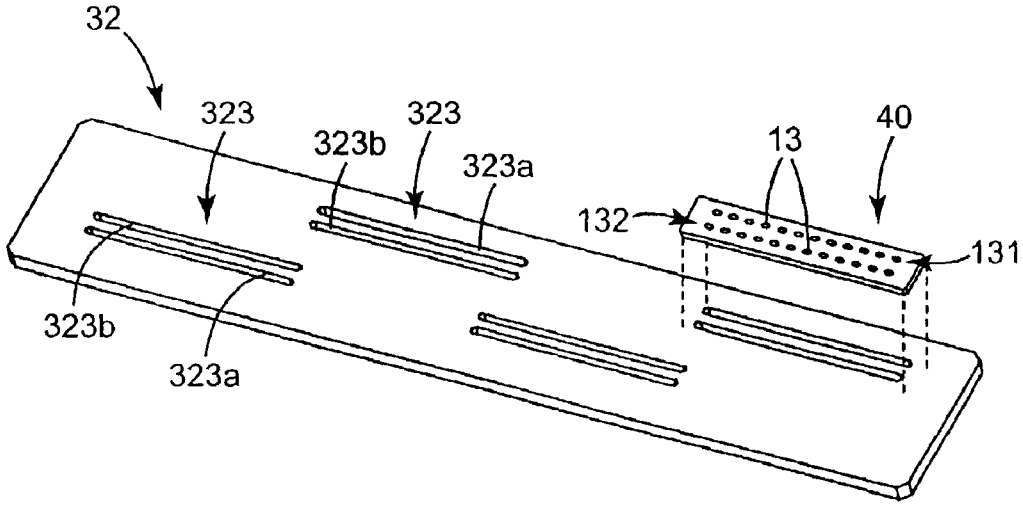
FIG. 7 is a top perspective view illustrating one embodiment of a substrate for an inkjet printhead assembly.

In one embodiment, as illustrated in FIG. 7, fluid passages 323 of substrate 32 each include a pair of fluid passages. More specifically, each fluid passage 323 includes a first fluid passage 323*a* and a second fluid passage 323*b*. Preferably, first fluid passage 323*a* and second fluid passage 323*b* are spaced from and oriented substantially parallel with each other. Printhead dies 40 are mounted on substrate 32 such that each printhead die 40 communicates with first fluid passage 323*a* and second fluid passage 323*b* of a respective fluid passage 323.

In one embodiment, also as illustrated in FIG. 7, nozzles 13 of printhead dies 40 are arranged to form a first nozzle set 131 and a second nozzle set 132. In one embodiment, first nozzle set 131 and second nozzle set 132 each include a column of orifices or nozzles such that first nozzle set 131 and second nozzle set 132 are spaced from and oriented substantially parallel from with each other. Each printhead die 40 is mounted on substrate 32 such that first nozzle set 131 communicates with first fluid passage 323*a* and second nozzle set 132 communicates with second fluid passage 323*b* of a respective fluid passage 323. As such, first fluid passage 323*a* of each pair of fluid passages 323 supplies fluid to first nozzle set 131 of a respective printhead die 40 and second fluid passage 323*b* of each pair of fluid passages 323 supplies fluid to second nozzle set 132 of a respective printhead die 40.

Figure 8:
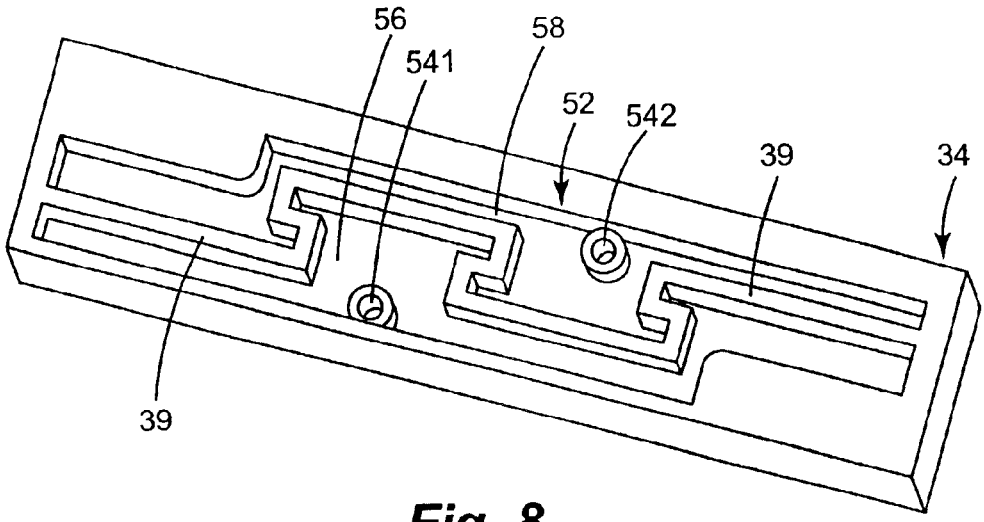
FIG. 8 is a top perspective view illustrating one embodiment of a substructure for an inkjet printhead assembly including one embodiment of a fluid manifold.
Figure 9:
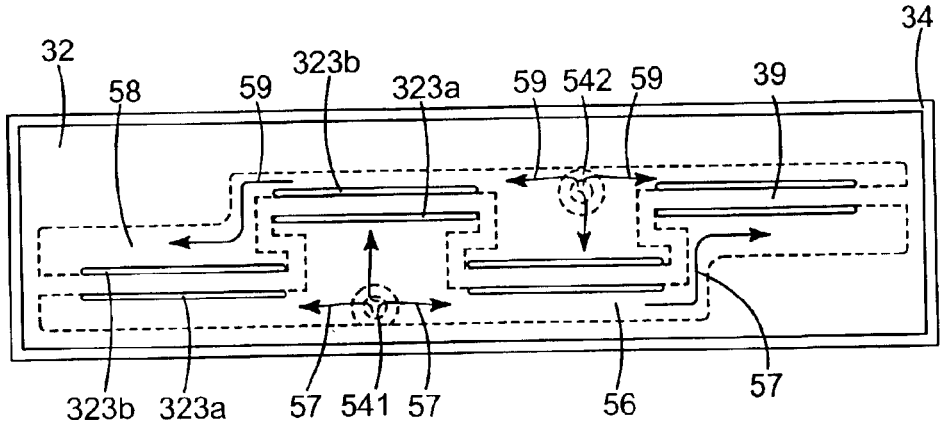
FIG. 9 is a top view illustrating the substrate of FIG. 7 supported by the substructure of FIG. 8.

In one embodiment, as illustrated in FIGS. 8 and 9, fluid manifold 52 of ink delivery system 50 is formed in substructure 34 of carrier 30. As such, fluid manifold 52 distributes ink or fluid to fluid passages 323 of substrate 32 and, therefore, printhead dies 40. In one embodiment, fluid manifold 52 includes a first chamber 56 and a second chamber 58. First chamber 56 and second chamber 58 are fluidically isolated from each other such that fluid in first chamber 56 does not mix with fluid in second chamber 58. First chamber 56 communicates with first fluid passage 323*a* of each pair of fluid passages 323 and second chamber 58 communicates with second fluid passage 323*b* of each pair of fluid passages 323.

In one embodiment, port 54 of ink delivery system 50 includes a first port 541 and a second port 542. First port 541 and second port 542 are formed in substructure 34 of carrier 30 such that first port 541 communicates with first chamber 56 of fluid manifold 52 and second port 542 communicates with second chamber 58 of fluid manifold 52. As such, first port 541 and first chamber 56 supply fluid to first fluid passage 323*a* of each pair of fluid passages 323, as illustrated by arrows 57, and second port 542 and second chamber 58 supply fluid to second fluid passage 323*b* of each pair of fluid passages 323, as illustrated by arrows 59.

In one embodiment, as illustrated in FIGS. 8 and 9, first chamber 56 extends along one side of substructure 34 and second chamber 58 extends along an opposite side of substructure 34. More specifically, first chamber 56 is substantially confined to one side of substructure 34 and second chamber 58 is substantially confined to the opposite side of substructure 34. An inner wall 39 of substructure 34 separates fluid manifold 52 into first chamber 56 and second chamber 58. In one embodiment, inner wall 39 is shaped such that first chamber 56 and second chamber 58 each include at least one substantially T-shaped portion.

With first chamber 56 formed along one side of substructure 34 and second chamber 58 formed along an opposite side of substructure 34, first fluid passage 323*a* includes the fluid passage of each pair of fluid passages 323 which is closest to one side of substructure 34 and second fluid passage 323*b* includes the fluid passage of each pair of fluid passages 323 which is closest to an opposite side of substructure 34. As such, first fluid passage 323*a* of each pair of fluid passages 323 communicates with first chamber 56 of fluid manifold 52 and second fluid passage 323*b* of each pair of fluid passages 323 communicates with second chamber 58 of fluid manifold 52. First nozzle set 131 of each printhead die 40, therefore, includes the column of orifices or nozzles 13 which is closest to one side of substructure 34 and second nozzle set 132 of each printhead die 40 includes the column of orifices or nozzles 13 which is closest to an opposite side of substructure 34.

Figure 10:
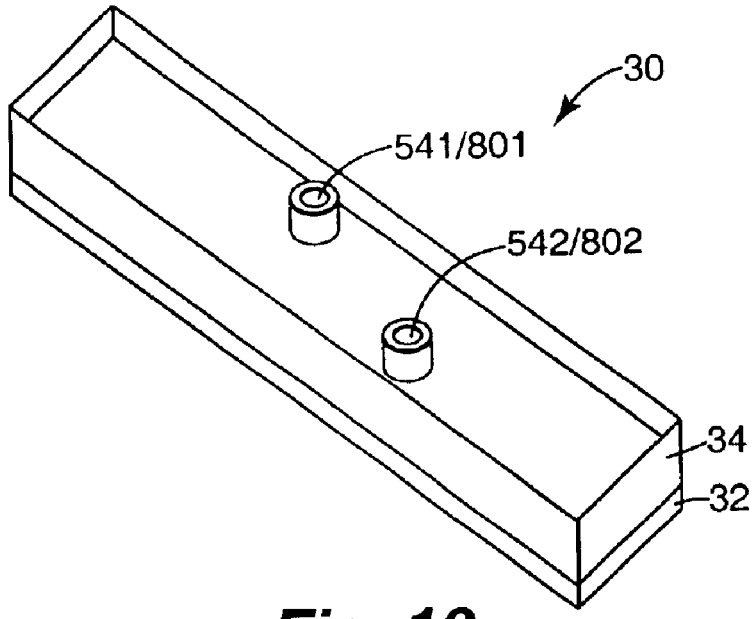
FIG. 10 is a bottom perspective view of the substructure and substrate of FIG. 9.

As illustrated in the embodiment of FIG. 10, substrate 32 is mounted on substructure 34 such that substrate 32 forms a first side of carrier 30 and substructure 34 forms a second side of carrier 30 opposite the first side thereof. As such, first fluid port 541 and second fluid port 542 communicate with the second side of carrier 30.

Figure 11:
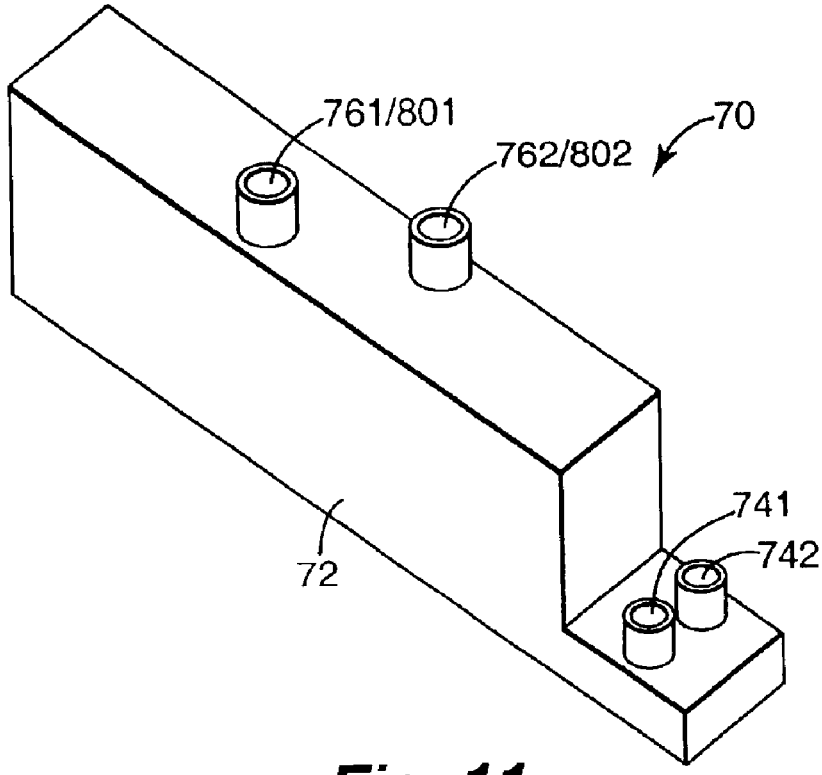
FIG. 11 is a top perspective view illustrating one embodiment of a fluid delivery assembly for an inkjet printhead assembly.

In one embodiment, as illustrated in FIG. 11, fluid delivery system 50 includes a fluid delivery assembly 70. Fluid delivery assembly 70 receives fluid from a fluid source and, in one embodiment, regulates a pressure of the fluid and filters the fluid for delivery to carrier 30. Fluid delivery assembly 70 is coupled with carrier 30 so as to communicate, in one embodiment, pressure regulated and filtered fluid with fluid manifold 52 of carrier 30.

In one embodiment, fluid delivery assembly includes a housing 72, a first fluid inlet 741, a second fluid inlet 742, a first fluid outlet 761, and a second fluid outlet 762. Fluid inlets 741 and 742 each communicate with a supply of fluid and, in one embodiment, communicate with supplies of differing fluids, such as inks of differing colors. In one embodiment, fluid delivery assembly 70 includes a first chamber which communicates with fluid inlet 741 and fluid outlet 761 and a second chamber which communicates with fluid inlet 742 and fluid outlet 762. As such, fluid received at fluid inlet 741 is supplied to fluid outlet 761 and fluid received at fluid inlet 742 is supplied to fluid outlet 762. Fluid outlets 761 and 762 communicate with fluid ports 541 and 542, respectively, such that fluid from fluid delivery assembly 70 is supplied to fluid manifold 52 and, more specifically, first chamber 56 and second chamber 58 of fluid manifold 52.

Fluid outlet 761 of fluid delivery assembly 70 and fluid port 541 of carrier 30 form a first fluid interconnect 801 which fluidically couples fluid delivery assembly 70 with first chamber 56 of fluid manifold 52, and fluid outlet 762 of fluid delivery assembly 70 and fluid port 542 of carrier 30 form a second fluid interconnect 802 which fluidically couples fluid delivery assembly 70 with second chamber 58 of fluid manifold 52. As such, fluid outlets 761 and 762 constitute fluid couplings associated with fluid delivery assembly 70 and fluid ports 541 and 542 constitute fluid couplings associated with carrier 30. Thus, fluid couplings of fluid delivery assembly 70 mate with respective fluid couplings of carrier 30 to delivery fluid from fluid delivery assembly 70 to carrier 30. Accordingly, fluid interconnects 801 and 802 each establish a fluid connection between fluid delivery assembly 70 and carrier 30.

Figure 12:
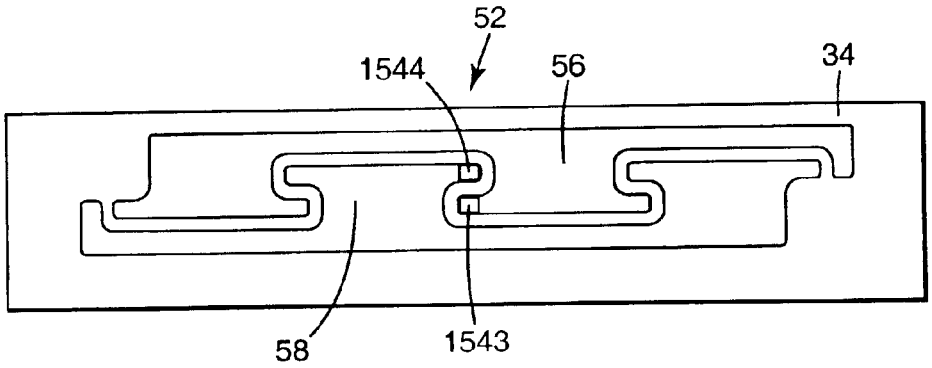
FIG. 12 is a top view illustrating one embodiment of a substructure for an inkjet printhead assembly including one embodiment of a fluid manifold.
Figure 13:
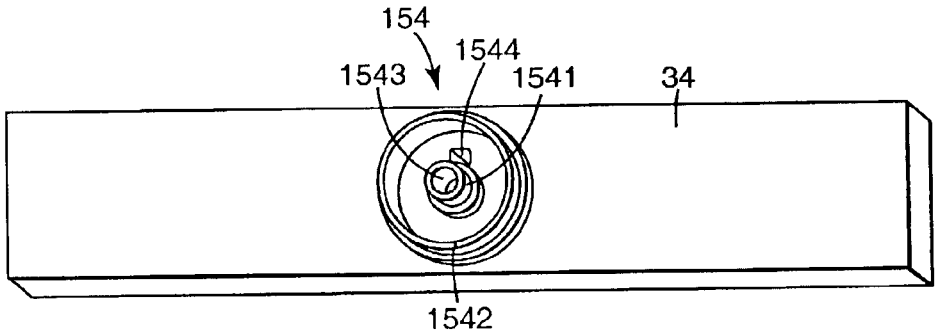
FIG. 13 is a bottom perspective view of the substructure of FIG. 12 including one embodiment of a first fluid coupling of a fluid interconnect.

FIGS. 12 and 13 illustrate substructure 34, including fluid manifold 52 having first chamber 56 and second chamber 58, with another embodiment of a fluid port. Fluid port 154 includes a first fitting 1541 and a second fitting 1542 concentric with first fitting 1541. In addition, fluid port 154 includes a first opening 1543 formed within first fitting 1541 and a second opening 1544 formed within second fitting 1542 such that first opening 1543 communicates with first chamber 56 of fluid manifold 52 and second opening 1544 communicates with second chamber 58 of fluid manifold 52.

In one embodiment, first fitting 1541 and second fitting 1542 are both substantially circular in shape. In addition, second opening 1544 of fluid port 154 is spaced radially from first opening 1543 of fluid port 154 such that second opening 1544 is formed within a ring spaced concentrically from first opening 1543.

Figure 14:
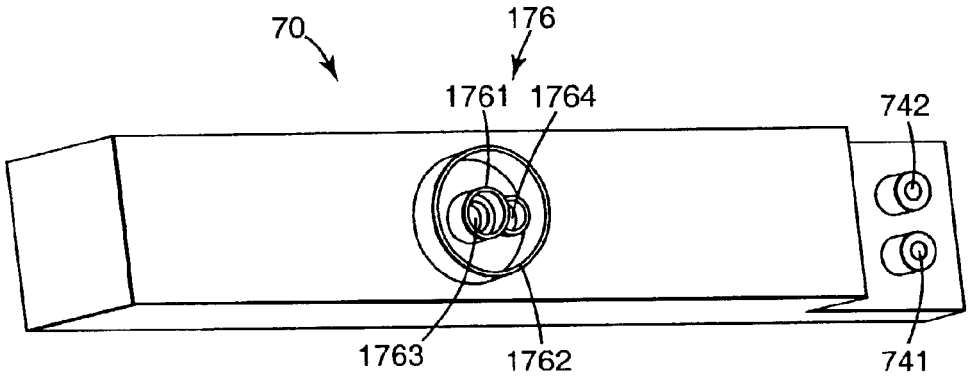
FIG. 14 is a top perspective view illustrating one embodiment of a fluid delivery assembly including one embodiment of a second fluid coupling of a fluid interconnect.

FIG. 14 illustrates another embodiment of fluid delivery assembly 70 with a fluid outlet 176 adapted to mate with fluid port 154 of substructure 34. Similar to fluid port 154, fluid outlet 176 includes a first fitting 1761 and a second fitting 1762 concentric with first fitting 1761. In addition, fluid outlet 176 includes a first opening 1763 formed within first fitting 1761 and a second opening 1764 formed within second fitting 1762.

In one embodiment, first fitting 1761 and second fitting 1762 are both substantially circular in shape. In addition, second opening 1764 of fluid outlet 176 is spaced radially from first opening 1763 of fluid outlet 176 such that second opening 1764 is formed within a ring spaced concentrically from first opening 1763.

Figure 15:
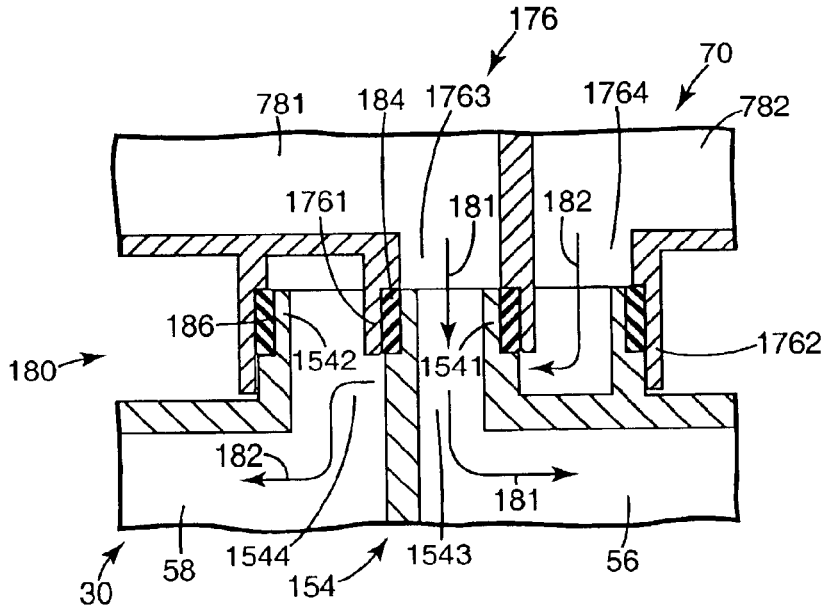
FIG. 15 is a cross-sectional view of the first fluid coupling of FIG. 13 mated with the second fluid coupling of FIG. 14.

In one embodiment, as illustrated in FIG. 15, fluid outlet 176 of fluid delivery assembly 70 mates with fluid port 154 of carrier 30 to form a fluid interconnect 180 which fluidically couples fluid delivery assembly 70 with fluid manifold 52 of carrier 30. More specifically, first opening 1763 of fluid outlet 176 communicates with first opening 1543 of fluid port 154 to form a fluid flow path, as illustrated by arrows 181, between a first chamber 781 of fluid delivery assembly 70 and first chamber 56 of fluid manifold 52. In addition, second opening 1764 of fluid outlet 176 communicates with second opening 1544 of fluid port 154 to form a fluid flow path, as illustrated by arrows 182, between a second chamber 782 of fluid delivery assembly 70 and second chamber 58 of fluid manifold 52. As such, fluid interconnect 180 establishes a single fluid connection between fluid delivery assembly 70 and carrier 30 which communicates fluid between first chamber 781 of fluid delivery assembly 70 and first chamber 56 of fluid manifold 52 and communicates fluid between second chamber 782 of fluid delivery assembly 70 and second chamber 58 of fluid manifold 52. In one embodiment, first chamber 781 and second chamber 782 of fluid delivery assembly 70 communicate with first fluid inlet 741 and second fluid inlet 742, respectively.

In one embodiment, an O-ring 184 is provided between first fitting 1541 of fluid port 154 and first fitting 1761 of fluid outlet 176 and an O-ring 186 is provided between second fitting 1542 of fluid port 154 and second fitting 1762 of fluid outlet 176. As such, O-rings 184 and 186 contribute to form a fluidic seal between fluid port 154 and fluid outlet 176.

Figure 16:
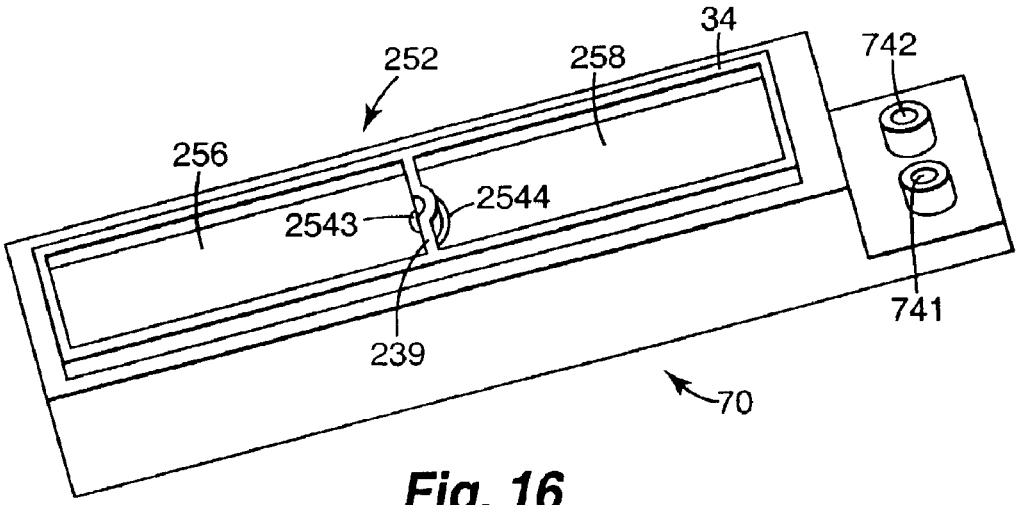
FIG. 16 is a top perspective view illustrating another embodiment of a substructure and a fluid delivery assembly including another embodiment of a fluid interconnect.
Figure 17:
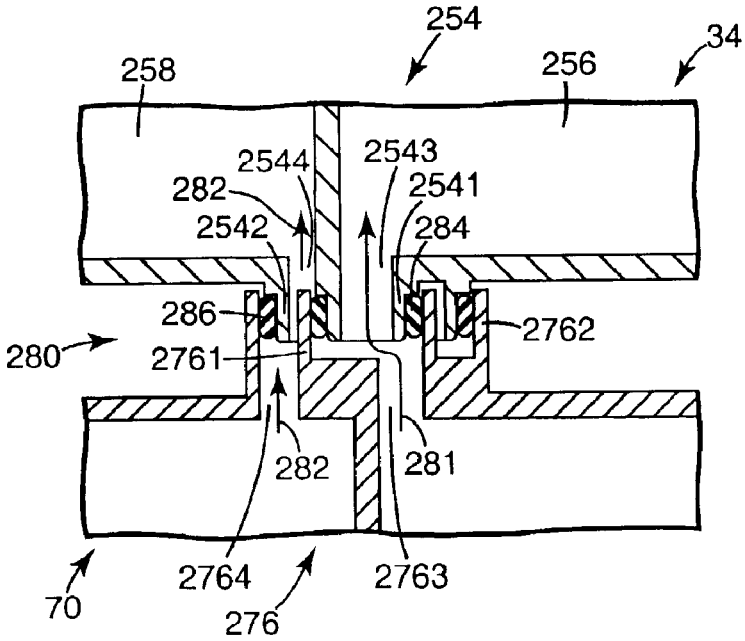
FIG. 17 is a cross-sectional view of the fluid interconnect of FIG. 16.

FIGS. 16 and 17 illustrate substructure 34, with another embodiment of a fluid manifold and a fluid port, coupled fluid delivery assembly 70. Fluid manifold 252 includes a first chamber 256 and a second chamber 258. First chamber 256 is provided at one end of substructure 34 and second chamber 258 is provided at an opposite end of substructure 34. As such, first chamber 256 communicates with a first set of fluid passages 323 and, therefore, a first set of printhead dies 40, and second chamber 258 communicates with a second set of fluid passages 323 and, therefore, a first set of printhead dies 40. An inner wall 239 of substructure 34 separates fluid manifold 252 into first chamber 256 and second chamber 258.

Fluid port 254 includes a first fitting 2541 and a second fitting 2542 concentric with first fitting 2541. In addition, fluid port 254 includes a first opening 2543 formed within first fitting 2541 and a second opening 2544 formed within second fitting 2542 such that first opening 2543 communicates with first chamber 256 of fluid manifold 252 and second opening 2544 communicates with second chamber 258 of fluid manifold 252.

In the embodiment of FIGS. 16 and 17, first fitting 2541 and second fitting 2542 are both substantially circular in shape. In addition, second opening 2544 of fluid port 254 is spaced radially from first opening 2543 of fluid port 254 such that second opening 2544 is formed along an arc spaced concentrically from first opening 2543.

As illustrated in FIG. 17, fluid delivery assembly 70 includes a fluid outlet 276 adapted to mate with fluid port 254 of substructure 34. Fluid outlet 276 includes a first fitting 2761 and a second fitting 2762 concentric with first fitting 2761. Fluid outlet 276 includes a first opening 2763 formed within first fitting 2761 and a second opening 2764 formed within second fitting 2762.

In the embodiment of FIGS. 16 and 17, first fitting 2761 and second fitting 2762 are both substantially circular in shape. In addition, second opening 2764 of fluid outlet 276 is spaced radially from first opening 2763 of fluid outlet 276 such that second opening 2764 is formed along an arc spaced concentrically from first opening 2763.

Fluid outlet 276 of fluid delivery assembly 70 mates with fluid port 254 of carrier 30 to form a fluid interconnect 280 which fluidically couples fluid delivery assembly 70 with fluid manifold 252 of carrier 30. More specifically, first opening 2763 of fluid outlet 276 communicates with first opening 2543 of fluid port 254 to form a fluid flow path, as illustrated by arrow 281, between a first chamber 781 of fluid delivery assembly 70 and first chamber 256 of fluid manifold 252. In addition, second opening 2764 of fluid outlet 276 communicates with second opening 2544 of fluid port 254 to form a fluid flow path, as illustrated by arrows 282, between a second chamber 782 of fluid delivery assembly 70 and second chamber 258 of fluid manifold 252. As such, fluid interconnect 280 establishes a single fluid connection between fluid delivery assembly 70 and carrier 30 which communicates fluid between first chamber 781 of fluid delivery assembly 70 and first chamber 256 of fluid manifold 252 and communicates fluid between second chamber 782 of fluid delivery assembly 70 and second chamber 258 of fluid manifold 252. In one embodiment, first chamber 781 and second chamber 782 of fluid delivery assembly 70 communicate with first fluid inlet 741 and second fluid inlet 742, respectively.

In the embodiment of FIGS. 16 and 17, an O-ring 284 is provided between first fitting 2541 of fluid port 254 and first fitting 2761 of fluid outlet 276 and an O-ring 286 is provided between second fitting 2542 of fluid port 254 and second fitting 2762 of fluid outlet 276. As such, O-rings 284 and 286 contribute to form a fluidic seal between fluid port 254 and fluid outlet 276.

By forming fluid ports 154 and 254 and fluid outlets 176 and 276 with respective concentric first and second fittings 1541,1542; 2541,2542; 1761,1762; and 2761,2762, fluid ports 154 and 254 and fluid outlets 176 and 276 form respective concentric fluid interconnects 180 and 280. As such, fluid interconnects 180 and 280 provide single fluid connections between first chamber 781 of fluid delivery assembly 70 and first chamber 256 of fluid manifold 252 and second chamber 782 of fluid delivery assembly 70 and second chamber 258 of fluid manifold 252. In addition, by forming the respective fittings concentric with each other, alignment variations between the fluid couplings are minimized since the fluid couplings are centered about a common point. Furthermore, coupling or assembly directions and/or orientations of fluid delivery assembly 70 and carrier 30 are increased relative to fluid couplings arranged in a linear manner since the fluid couplings have common axes around which fluid delivery assembly 70 and/or carrier 30 may be rotated.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A printhead assembly, comprising:

a carrier having a fluid manifold defined therein, the fluid manifold including a first chamber and a second chamber;

a plurality of printhead dies each mounted on the carrier and communicating with at least one of the first chamber and the second chamber of the fluid manifold;

a fluid delivery assembly coupled with the carrier and including a first chamber and a second chamber; and a fluid interconnect fluidically coupling the first chamber of the fluid manifold with the first chamber of the fluid delivery assembly and the second chamber of the fluid manifold with the second chamber of the fluid delivery assembly.

2. The printhead assembly of claim 1, wherein the fluid interconnect includes a first opening and a second opening spaced radially from the first opening.

3. The printhead assembly of claim 1, wherein the fluid interconnect forms a first fluid flow path between the first chamber of the fluid manifold and the first chamber of the fluid delivery assembly and a second fluid flow path between the second chamber of the fluid manifold and the second chamber of the fluid delivery assembly.

4. The printhead assembly of claim 1, wherein the fluid interconnect includes a first fluid coupling having a first fitting and a second fitting concentric with the first fitting thereof, and a second fluid coupling mated with the first fluid coupling and having a first fitting and a second fitting concentric with the first fitting thereof.

5. The printhead assembly of claim 4, wherein the first fluid coupling includes a first opening formed within the first fitting thereof and a second opening formed within the second fitting thereof, and the second fluid coupling includes a first opening formed within the first fitting thereof and a second opening formed within the second fitting thereof.

6. The printhead assembly of claim 5, wherein the first opening of the first fluid coupling and the first opening of the second fluid coupling form a first fluid flow path between the first chamber of the fluid manifold and the first chamber of the fluid delivery assembly, and wherein the second opening of the first fluid coupling and the second opening of the second fluid coupling form a second fluid flow path between the second chamber of the fluid manifold and the second chamber of the fluid delivery assembly.

7. The printhead assembly of claim 4, wherein the first fluid coupling is formed on one of the carrier and the fluid delivery assembly, and the second fluid coupling is formed on the other of the carrier and the fluid delivery assembly.

8. The printhead assembly of claim 1, wherein each of the printhead dies communicate with the first chamber and the second chamber of the fluid manifold.

9. The printhead assembly of claim 1, wherein the first chamber of the fluid delivery assembly, the fluid interconnect, and the first chamber of the fluid manifold are adapted to supply fluid to at least one of the printhead dies, and wherein the second chamber of the fluid delivery assembly, the fluid interconnect, and the second chamber of the fluid manifold are adapted to supply fluid to at least one of the printhead dies.

10. A method of forming a printhead assembly, the method comprising:

forming a fluid manifold including a first chamber and a second chamber in a carrier;

mounting a plurality of printhead dies on the carrier, including communicating each of the printhead dies with at least one of the first chamber and the second chamber of the fluid manifold; and coupling a fluid delivery assembly including a first chamber and a second chamber with the carrier, including fluidically coupling the first chamber of the fluid manifold with the first chamber of the fluid delivery assembly and the second chamber of the fluid manifold with the second chamber of the fluid delivery assembly via a fluid interconnect.

11. The method of claim 10, wherein fluidically coupling the fluid manifold with the fluid delivery assembly includes radially spacing a second opening of the fluid interconnect from a first opening of the fluid interconnect.

12. The method of claim 10, wherein fluidically coupling the fluid manifold with the fluid delivery assembly includes forming a first fluid flow path between the first chamber of the fluid manifold and the first chamber of the fluid delivery assembly, and forming a second fluid flow path between the second chamber of the fluid manifold and the second chamber of the fluid delivery assembly.

13. The method of claim 10, wherein the fluid interconnect includes a first fluid coupling having a first fitting and a second fitting concentric with the first fitting thereof, and a second fluid coupling mated with the first fluid coupling and having a first fitting and a second fitting concentric with the first fitting thereof.

14. The method of claim 13, wherein the first fluid coupling includes a first opening formed within the first fitting thereof and a second opening formed within the second fitting thereof, and the second fluid coupling includes a first opening formed within the first fitting thereof and a second opening formed within the second fitting thereof.

15. The method of claim 14, wherein fluidically coupling the fluid manifold with the fluid delivery assembly includes forming a first fluid flow path between the first chamber of the fluid manifold and the first chamber of the fluid delivery assembly with the first opening of the first fluid coupling and the first opening of the second fluid coupling, and forming a second fluid flow path between the second chamber of the fluid manifold and the second chamber of the fluid delivery assembly with the second opening of the first fluid coupling and the second opening of the second fluid coupling.

16. The method of claim 13, further comprising:

forming the first fluid coupling on one of the carrier and the fluid delivery assembly, and forming the second fluid coupling on the other of the carrier and the fluid delivery assembly.

17. The method of claim 10, wherein communicating each of the printhead dies with at least one of the first chamber and the second chamber of the fluid manifold includes communicating each of the printhead dies with the first chamber and the second chamber of the fluid manifold.

18. A method of supplying fluid from a fluid delivery assembly to a plurality of printhead dies each mounted on a carrier having a fluid manifold defined therein, the method comprising:

communicating a first chamber of the fluid manifold with at least one of the printhead dies and a second chamber of the fluid manifold with at least one of the printhead dies;

fluidically coupling a first chamber of the fluid delivery assembly with the first chamber of the fluid manifold and a second chamber of the fluid delivery assembly with the second chamber of the fluid manifold via a fluid interconnect; and distributing fluid to at least one of the printhead dies through the first chamber of the fluid delivery assembly, the fluid interconnect, and the first chamber of the fluid manifold, and distributing fluid to at least one of the printhead dies through the second chamber of the fluid delivery assembly, the fluid interconnect, and the second chamber of the fluid manifold.

* * * * *